US008161895B2

(12) United States Patent
Grufman et al.

(10) Patent No.: US 8,161,895 B2
(45) Date of Patent: Apr. 24, 2012

(54) MACHINE-ASSISTED FREE-HAND EMBROIDERY METHOD

(75) Inventors: Hans Grufman, Jönköping (SE); Henrik Eklund, Tenhult (SE)

(73) Assignee: VSM Group AB, Huskvarna (SE)

( * ) Notice: Subject to any disclaimer, the term of this patent is extended or adjusted under 35 U.S.C. 154(b) by 1042 days.

(21) Appl. No.: 12/081,558

(22) Filed: Apr. 17, 2008

(65) Prior Publication Data

US 2008/0257240 A1 Oct. 23, 2008

(30) Foreign Application Priority Data

Apr. 18, 2007 (SE) ..... 0700941

(51) Int. Cl.
*D05C 3/00* (2006.01)

(52) U.S. Cl. ..... 112/78

(58) Field of Classification Search ..... 112/78, 112/102.5, 103, 470.01, 470.04, 470.06, 112/260, 475.05, 475.19, 275
See application file for complete search history.

(56) References Cited

U.S. PATENT DOCUMENTS 4,388,883 A * 6/1983 Hirota et al. ..... 112/102.5
4,444,135 A * 4/1984 Yanagi et al. ..... 112/470.04
4,499,838 A * 2/1985 Voza ..... 112/475.19
5,216,615 A * 6/1993 Yokoe et al. ..... 700/137
5,231,941 A * 8/1993 Wakayama ..... 112/102.5
5,255,198 A * 10/1993 Yokoe et al. ..... 700/138
5,284,104 A * 2/1994 Hori et al. ..... 112/102.5
5,291,843 A * 3/1994 Hori ..... 112/103
5,666,894 A * 9/1997 Jonsson et al. ..... 112/103

FOREIGN PATENT DOCUMENTS

JP 5245277 A 9/1993

* cited by examiner

*Primary Examiner* — Tejash Patel
(74) *Attorney, Agent, or Firm* — Venable LLP; Eric J. Franklin

(57) ABSTRACT

A method and device for free-hand embroidering on a sewing material with a sewing machine which has a memory for stitch data for a sewing pattern and a processor for reading the stitch data and for causing the sewing machine to execute stitches according to stitch data, which sewing machine has a needle and a sewing material feeder for moving the sewing material in a direction, which processor controls movements according to the direction relative to the position of the needle for the execution of stitches according to the sewing pattern, and which method includes during use of the sewing machine in a free-hand mode: storage in the memory of stitch data for at least one stitch type for free-hand embroidering, choice of a stitch type, maneuvering, via first control signals, a movement of the sewing material feeder in any desired the direction by using a hand-operated control, detection of the first control signals in the processor, calculation in the processor, from the first control signals, of the direction and/or speed of the movement, and control of the sewing material feeder by the processor, via second control signals, for the execution of stitches in the direction and/or at the speed in accordance with stitch data for the chosen stitch type.

14 Claims, 6 Drawing Sheets

MACHINE-ASSISTED FREE-HAND EMBROIDERY METHOD

CROSS-REFERENCE TO RELATED APPLICATIONS

This application claims priority to Swedish patent application 0700941-8 filed 18 Apr. 2008.

TECHNICAL FIELD

The present invention relates to a sewing machine and a method for using a sewing machine for executing an embroidery, in which the machine has means for executing an embroidery according to a stitch pattern stored in a memory of the machine and an operator is further afforded the possibility of effecting manual feed of a sewing material during embroidering.

STATE OF THE ART

It is known that embroideries can be executed with a sewing machine in which the embroidery is stored in a memory which contains stitch data for the embroidery. By way of example, an operator selects an embroidery from the memory and stretches a sewing material, on which the embroidery is to be executed, on an embroidery hoop disposed relative to the machine in such a way that a control program for the machine moves the hoop mechanically according to the control program and the stitch data during the execution of the embroidery on the sewing material. The sewing material is usually a fabric, which is the term hereinafter used by way of example to denote every kind of sewing material.

When free-hand embroidering is to be executed, the fabric is usually moved freehandedly by the operator. The fabric is not fed by the sewing machine, but the needle of the machine can execute movements according to a sewing pattern stored in the machine's memory. The actual feed of the fabric for a stitch depends both on the speed of a main motor of the machine and the speed applied free-handedly to the fabric. The operator has to control both of these parameters continuously during the sewing. It is difficult to achieve good results in these conditions.

JP 05-245277 refers to a solution to the problem, whereby the sewing machine is provided with a selector switch for choosing a mode of manual embroidering, with a number of setting devices for choosing various parameters which define the seam in the manually executed portion of the embroidery. That method entails the machine having to be halted during the embroidering and the various parameters having to be set before it can be resumed. The embroidering thereafter proceeds with machine-controlled fabric feed according to set values with respect to, for example, direction, speed, stitch type etc., after which the machine is halted again and new parameters can be set. It is even questionable whether this process can even be called free-hand embroidering, since the machine has to be halted for desired changes of parameters.

When an operator controls the fabric directly by hand, this may also be enshrined in some kind of framework, e.g. it being desirable that the operator controls the guidance of the movements of the fabric. The following are two examples of this:

1. Straight seam: When sewing straight stitches it is usually desirable to achieve a constant stitch length. A number of solutions for causing the sewing machine to assist the operator are known. They involve the stitch length being assessed by some kind of sensor. The stitch length may be controlled by regulating the speed of the main motor of the sewing machine. Said motor is run at a higher speed if the operator moves the fabric quickly and at a lower speed if the fabric is moved slowly.
2. Flat seam: When sewing flat seam stitches in free-hand embroidering, the fabric is moved by the operator by means of the embroidery hoop, but the movement of the needle is controlled by the sewing machine. In this case the speed of the fabric needs to be constant if good results are to be obtained. There are no known solutions which provide the operator with any form of assistance for achieving this. A reason for this is that the fabric feed length per flat seam stitch is very short. This means that even small absolute feed length deviations per stitch during manual feed result in large feed length deviations for such stitches, relative to the intended feed.

As well as the abovementioned methods in which the stitch length is measured and the main motor is controlled according to measured values, there is another method, using a PC. In that case, data are created for the sewing pattern in a PC program. The sewing pattern is created in a manner which resembles free-hand embroidering. The operator specifies a desired stitch path by means of an input device, e.g. a computer mouse pertaining to the PC, with a symbolised needle controlled via the image of a piece of fabric on a screen. No actual movements of an actual sewing material are effected.

An object of the present invention is to propose a method for executing free-hand embroidering whereby the control program of the sewing machine is used for assisting an operator during the sewing. Another object is to provide the operator with auxiliary means for effecting fabric feed during free-hand embroidering. The main object is to achieve a more uniform stitch length during free-hand embroidering.

DESCRIPTION OF THE INVENTION

During embroidering, as previously mentioned, the sewing material is guided by the processor, both in automatic mode and in free-hand mode, according to the inventon's aspect of an auxiliary means for moving the sewing material in a direction which comprises at least a component of a first coordinate and a component of a second coordinate, in which said auxiliary means is exemplified below by an embroidery hoop in which the sewing material, i.e. the fabric, is stretched.

In general, an embroidering unit, which is a part of the sewing machine which is used specifically in free-hand embroidering, with the aforesaid embroidery hoop forming part of the embroidering unit, is used for moving the fabric. The sewing machine guides the hoop in two directions, e.g. an X direction and a Y direction, by means of stepping motors, one for each direction. An embroidering machine, irrespective of whether it is usable for free-hand embroidering or not, controls the movements of the hoop according to stitch coordinate data stored in a memory accessible to the sewing machine. The method for free-hand embroidering herein described makes it possible for the user to guide the hoop freely in the X direction and the Y direction and, of course, in both directions simultaneously, by using some input device, herein called control means, which may take the form of a coordinate sensor, such as a computer mouse, or of a corresponding direction and speed sensor, e.g. in the form of a joystick. This means that the hoop is not controlled only by stitch coordinate data such as those stored in the machine's memory. The machine's processor continuously detects the values of the control means on the basis of signals from the control means which are put into the processor in the form of what are herein called "first signals" from which the processor calculates the required speed and direction for the movements of the hoop (controlled by the embroidering unit) if they are to correspond to what is prescribed by the movements of the control means. These hoop movements are effected by the processor controlling said stepping motors, via what are herein called "second control signals", according to the calculated movements. Since the time required for the calculations and the control action which the processor executes secondarily for the secondary movement is very short, the hoop movements which are controlled by the processor will be perceived by the operator as simultaneous with the movements executed with the control means.

The present document describes a method for "simultaneous" free-hand embroidering in which the control of stitch positioning becomes more correct than by known methods. This means that the method and the control means are able to deal with stitches in both straight seams and flat seams. Existing methods can only cope with free-hand embroidering which involves straight seams. In the present text, "simultaneous" means that stitches are executed almost instantly when the operator prescribes them via the control means.

In brief, the method caters for free-hand embroidering on a sewing material with a sewing machine which has access to a memory for stitch data for a sewing pattern and a processor for reading said stitch data and for causing the machine to execute stitches according to the stitch data, which machine has a needle which performs a reciprocating movement along substantially a perpendicular to the sewing material, and an auxiliary means for moving the sewing material in a direction which comprises at least one out of a component for a first coordinate and a component for a second coordinate, which processor, when an automatic mode is selected, guides movements according to said direction with respect to the position of the needle and synchronously with the movement of the needle for the execution of stitches according to the sewing pattern, and which method, when the sewing machine is switched to a free-hand mode, comprises the following steps: storage of stitch data in said memory for at least one stitch type for use during said free-hand embroidering, choice of a stitch type, instigation, via first control signals, of a movement of said auxiliary means in any desired said direction by using a hand-operated control means such as a joystick or computer mouse, continuous detection of said first control signals in a processor, calculation in the processor, from said first control signals, of at least the direction of the movement, and guidance of the auxiliary means by the processor, via second control signals, for the execution of stitches in said direction in accordance with stitch data for the chosen stitch type.

The method further comprises the following steps: calculation in the processor, from said first control signals, of the speed of the movement, determination of stitch length according to the speed of said movement, and guidance of the auxiliary means, via said second control signals, for the execution of stitches with said stitch length.

A variant of the method according to the invention comprises the step of guidance of the auxiliary means, via said second control signals, for sewing at a speed equal to said calculated speed when said calculated speed is not greater than the machine's maximum sewing speed.

In further variants of the method according to the invention there area number of modes which may be chosen by the operator whereby the sewing machine is set to act in a desired manner in situations where the operator moves the sewing material, via the control means, at a speed exceeding he speed at which the machine is capable of sewing the stitch type required.

The free-hand embroidering may be executed in various modes of operation. In all of them, the operator specifies via the input unit, i.e. the control means, the speed of the sewing machine, the sewing direction and, in some cases, the stitch length. In a variant, the operator may also vary the pattern width via said input unit. The specific difference from prior art is the way in which the information is handled by the machine. It is of course possible to set some of said parameters via an operating device on the actual machine, e.g. the stitch length can very well be regulated by using such an operating device.

The method according to the invention further comprises the step of:

guidance of the auxiliary means, via said second control signals, for sewing at a speed determined by a mode of operation set by the machine operator, in which a first mode of operation means that when the operator moves the sewing material at a speed greater than maximum sewing speed of the machine, the direction and speed for a subsequent stitch are only detected when a preceding stitch has been sewn (it cannot be detected quicker than the machine can manage to sew), a second mode of operation means that when the operator moves the sewing material at a speed greater than maximum sewing speed of the machine, stitches which the machine cannot manage to sew simultaneously because its maximum sewing speed is exceeded are stored in a memory for non-simultaneous sewing of the stored stitches and a third mode of operation means that when the operator moves the sewing material at a speed greater than maximum sewing speed of the machine, the processor reduces the stitch length in order to reach a higher sewing speed.

The method according to the invention further comprises the step of control of the stitch width via a setting device, e.g. a handwheel, disposed on said control means, or via an operating device disposed on the sewing machine.

The advantages of the method according to the invention are that the stitch length in free-hand embroidering with sewing machine assistance will be more correct than by previous known "direct" methods (i.e. with direct hand manipulation of the fabric or the hoop). The result is a system which can deal with both straight seams and flat seams. Existing methods can only cope with straight seams. In this context, "direct" method means stitches being executed by the machine without any online control of the stitches via an input device.

Stitch types further to the abovementioned, stitches in straight seams and flat seams, may be used in the free-hand embroidering, in which case stitch data for the further stitch type need to be stored in a memory in such a way as to be accessible during work in free-hand mode on the machine.

Relative to PC-based free-hand embroidering, the method according to the invention makes it possible to execute free-hand embroidering simultaneously in a manner corresponding to a purely manual method in which the operator controls the sewing material directly by hand.

LIST OF DRAWINGS

DESCRIPTION OF EMBODIMENTS

A number of embodiments of the invention are described below with reference to the attached drawings.

Figure 1:
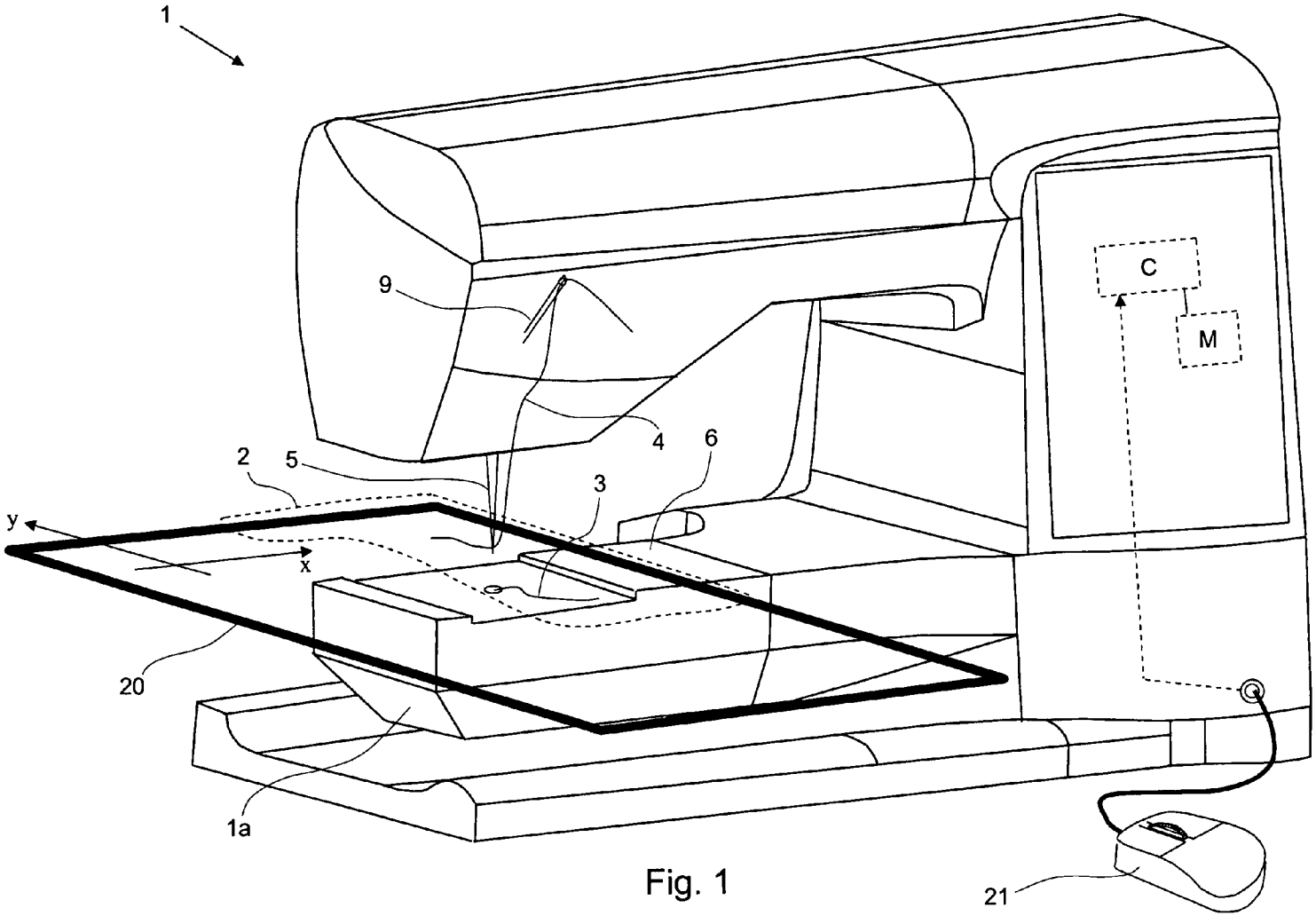
FIG. 1 depicts a schematic diagram of a sewing machine with an embroidery hoop fitted in it and a control means for controlling the hoop.

An embroidery sewing machine 1 is depicted by way of a functional example in FIG. 1, in which according to the example a sewing machine for lock stitches is used for executing stitches of a desired embroidery, and a fabric 2 is moved in a known manner between an underthread 3 and an overthread 4 in order to execute a seam comprising desired stitches (or stitch types) made by a needle 5 which moves periodically through the fabric 2. In this example, the fabric 2 is moved across a sewing table 6 which also accommodates a lower bobbin intended for the underthread 3 and encased in a gripper in a known manner (not depicted) in a lower arm 1*a* of the machine. The overthread 4 is led via a take-up lever 9 which, by a cyclic up and down movement, creates below the fabric 2 a loop of the overthread 4 when the needle 5, which has the overthread 4 running through its eye, has carried the overthread through the fabric 2 and the take-up lever 9 reverses back upwards from its lowest position. A tip (not depicted) of the gripper hooks in a known manner into said loop when the gripper rotates cyclically in a manner coordinated with the needle. To execute a stitch, in this case a lock stitch, the needle 5 performs a reciprocating movement, in principle in a direction perpendicular to the fabric 2, so that it leads the overthread 4 down through the fabric 2, after which the gripper leads the overthread 4 round a bobbin which carries the underthread 3, resulting in a knot in the fabric 2 when the needle moves back up through the fabric and the take-up lever 9 tightens the knot in the stitch.

As in prior art technology, the sewing machine is provided with a control program which is, for example, stored in a processor C. The machine also has an accessible memory M which is preferably disposed in the machine but may also be situated externally and be accessible by the processor C. The memory M for the sewing machine 1 has the possibility, when the machine is used for embroidering, of storing sewing patterns for embroideries in the form of stitch data for one or more such sewing patterns. The memory may also store stitch data for stitch types intended to be used in machine-assisted free-hand embroidering according to the present invention. Examples of such stitch data are stitch data for stitches in straight seams and stitches in flat seams.

FIG. 1 also depicts an embroidery hoop 20 adapted to the sewing machine, with a piece of fabric 2 stretched in the hoop. The piece of fabric 2 is only symbolically depicted in the diagram as covering only part of the hoop and is drawn in the form of a broken line to make the devices clearer. The hoop 20 is fixed to a first feed device controlled by a first stepping motor (not depicted) which manoeuvres the hoop in an X direction which in this example substantially coincides with the longitudinal axis of the sewing machine. The hoop 20 is correspondingly fastened to a second feed device controlled by a second stepping motor (not depicted) which manoeuvres the hoop in a Y direction which in this example is perpendicular to the X direction and coincides with the sewing direction, i.e. the direction in which the needle executes a seam on the fabric 2 when no lateral deviation of the seam is required. By control of the stepping motors on the basis of signals from the processor C, the hoop 20, with the stretched piece of fabric, can be caused to move in any desired direction in the XY plane. The movements are effected by an undepicted embroidery unit which is prior art technology and not part of the present invention. The embroidery unit comprises said stepping motors and feed devices for the hoop 20, which is suitably connected to the embroidery unit and its feed.

A control means in the form of a coordinate sensor 21 is provided for guiding the fabric according to the invention. It delivers first control signals to the processor C of the sewing machine. The coordinate sensor 21 is controlled by the operator in order to move the fabric in desired directions in an XY plane corresponding to the XY plane of said embroidery hoop. The desired movement creates the first control signals, which are conveyed to the processor C, in which they are detected and information is extracted from them for acquisition of the direction of the movement executed by the operator in the XY plane, and also the speed at which the movement is effected. The processor C thereafter performs operations for creating second control signals by which the hoop 20 is manoeuvred in the manner indicated above. The coordinate sensor, also called the control means 21, may take the form of any desired device capable of creating said first control signals, e.g. computer mouse, keyboard, light pen, joystick, drawing screen, touch screen, touch pad, roller ball, drawing tablet etc. As previously mentioned, other types of sensors may be used, e.g. analogue sensors of the joystick type. The diagram shows the control means connected by wire to the processor of the sewing machine. It is of course perfectly possible for the first control signals to be sent to the processor wirelessly in a known manner.

Figure 2:
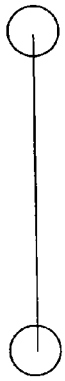
FIG. 2 depicts an example of a pattern for a first stitch type for free-hand embroidering.
Figure 3:
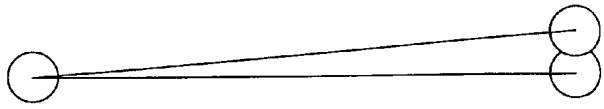
FIG. 3 depicts an example of a pattern for a second stitch type for free-hand embroidering.

When free-hand embroidering, hereinafter called FHE, is to be executed with the devices mentioned above, the stitches and the speed of the stepping motors of the embroidery unit are controlled ultimately by the operator. The stitches sewn by the machine are based on a pattern which is stored as stitch data for the respective stitch type in said memory. FIG. 2 and FIG. 3 depict two stitch patterns usable in executing FHE, the stitch in FIG. 2 representing the stitch in the pattern for the straight seam stitch type, and the stitches in FIG. 3 the stitch which constructs the pattern in the flat seam stitch type.

The circles on the stitches in the diagrams indicate the positions where the needle penetrates the fabric 2 during sewing. A knot of the overthread 4 and the underthread 3 is made at each of these positions. The straight lines between the circles indicate the movement path of the fabric 2 relative to the needle 5 between these positions. When a stitch type has been executed according to the stitch data, the overthread will be positioned along the paths depicted on the fabric between the circles.

When conventional embroidering is executed in an embroidering machine of this kind, the machine controls the embroidery unit entirely according to stitch data stored in the sewing machine's memory in every respect as regards stitch types, sewing directions etc. as in prior art technology. When FHE is executed, stitch data for one of a number of stitch types are used. As previously mentioned, these stitch data are stored in the machine's accessible memory. Said stitch data also present a basic configuration of the seam. One or more stitches of the chosen stitch type are sewn in sequence. The operator controls via said control means 21 the machine's sewing speed and sewing direction and, in some cases, the stitch length.

Figure 4:
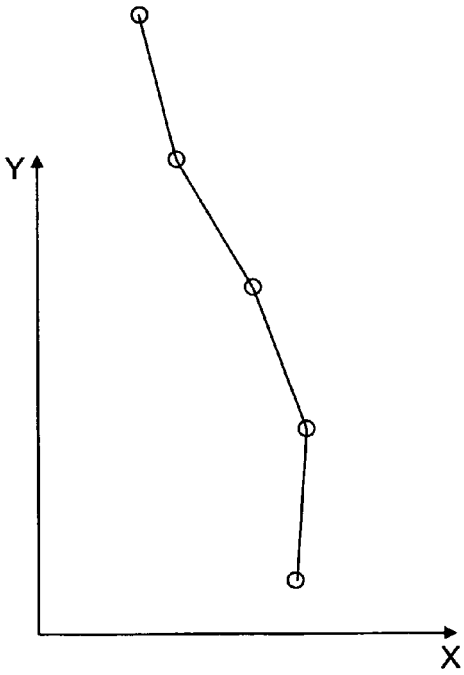
FIG. 4 depicts a seam in a free-hand embroidery executed with the pattern for the first stitch type.
Figure 5:
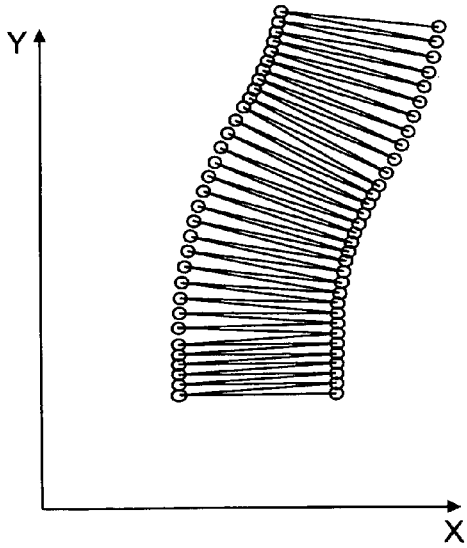
FIG. 5 depicts a seam in a free-hand embroidery executed with the pattern for the second stitch type.
Figure 6:
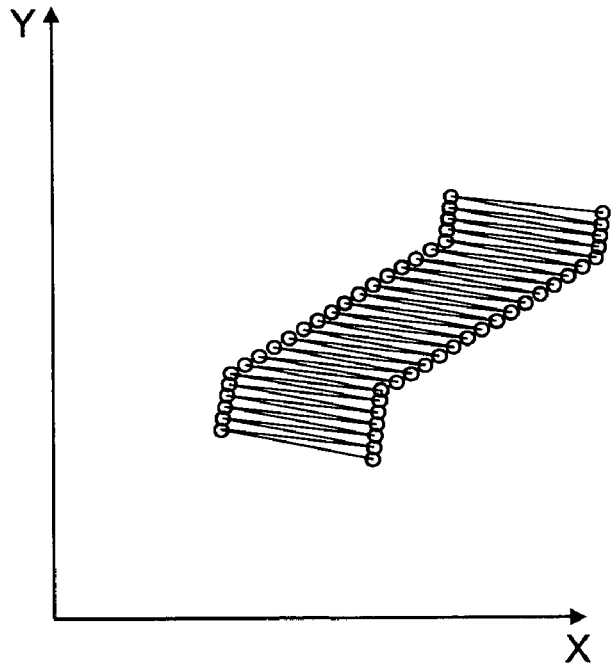
FIG. 6 depicts an alternative seam in a free-hand embroidery executed with the pattern for the second stitch type.

FIGS. 4, 5 and 6 depict examples in which a number of patterns are sewn by applying the FHE principle. The seam in FIG. 4 uses stitch data for straight seam stitches according to FIG. 2. The seams in FIGS. 5 and 6, which are embroidered by FHE, are executed with flat seam stitch data according to the pattern in FIG. 3.

We indicate below how the control means 21 (e.g. a coordinate sensor) affects the final result of embroidering executed by FHE.

Figure 7:
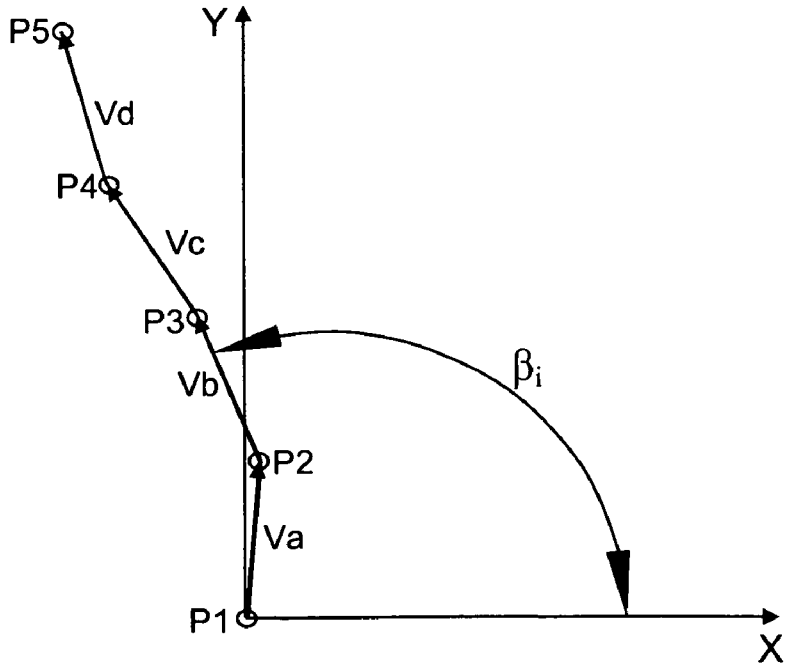
FIG. 7 illustrates the angle relative to the coordinates of the fabric for two mutually sampled positions during the movement of the control means.
Figure 8:
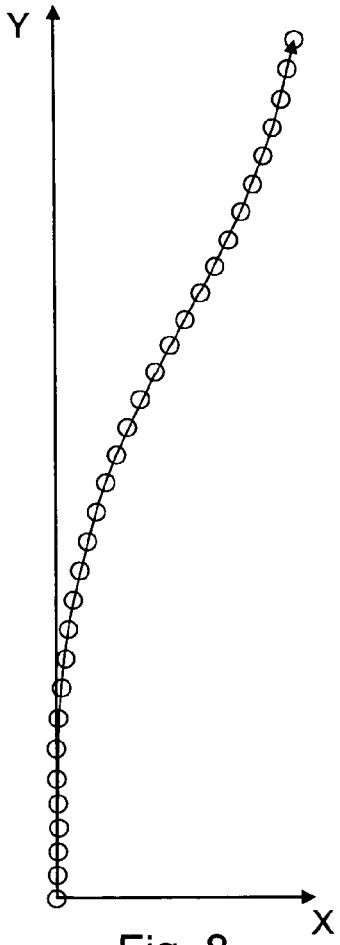
FIG. 8 illustrates the positions of the control means during the input of a seam depicted in FIG. 5.

The operator begins by choosing a stitch type. The pattern for the stitch type provides the basis for the configuration of the seam. The fabric 2 is fixed in the embroidery hoop 20 included in the embroidering unit of the sewing machine. The operator selects a starting point on the fabric for an FHE sequence of stitches, e.g. by using the control means 21 to cause the stepping motors of the embroidering unit to move the hoop 20 to the desired position for the starting point. This starting point is recorded in the sewing machine's memory when the operator has given the appropriate command via the machine's user interface. The position indicated, via the control means, for the starting point on the fabric 2 corresponds to point P1 in FIG. 7. The starting point on the fabric 2 may of course be chosen in some other way, e.g. via a button provided for the purpose on the sewing machine.

Points P2-P5 (in FIG. 7) represent the positions for the control means (e.g. the computer mouse) during an FHE sequence. The positions are recorded by the processor in accordance with the respective mode of operation chosen (see above). The various modes of operation are further described below.

The direction and length of the respective vectors Va-Vd are defined by points P1-P5. The direction of the vectors Va-Vd is indicated by the angle $\beta_i$ (e.g. $\beta_2$ corresponds to the direction for the vector Vb), which controls the respective direction of the seam. Stitch angles and stitch lengths may also be affected by stitch angles calculated in the chosen mode of operation. The length of the vectors controls the speed of the sewing machine and, in some cases, the stitch length. The stitch length and the direction of the vectors Va-Vd are calculated by the machine's processor C.

The angle between the pattern for the stitch type and the coordinates X-Y of the hoop 20 is acted upon by the control means (see also FIGS. 4 and 5). This is described in more detail below.

Figure 10:
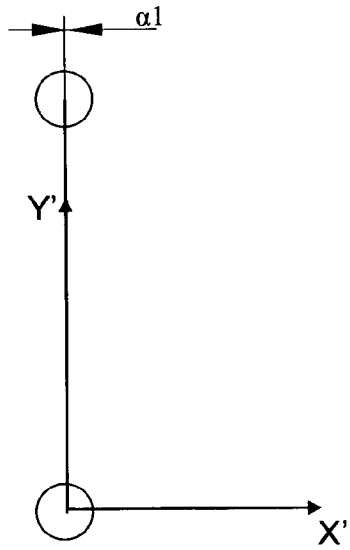
FIG. 10 illustrates the angle for the stitch relative to the coordinate system for the pattern for the stitch type.
Figure 9:
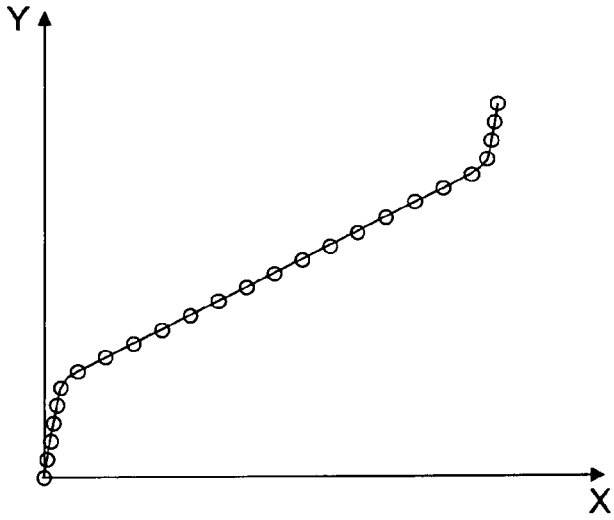
FIG. 9 illustrates the positions of the control means during the input of a seam depicted in FIG. 6.
Figure 11:
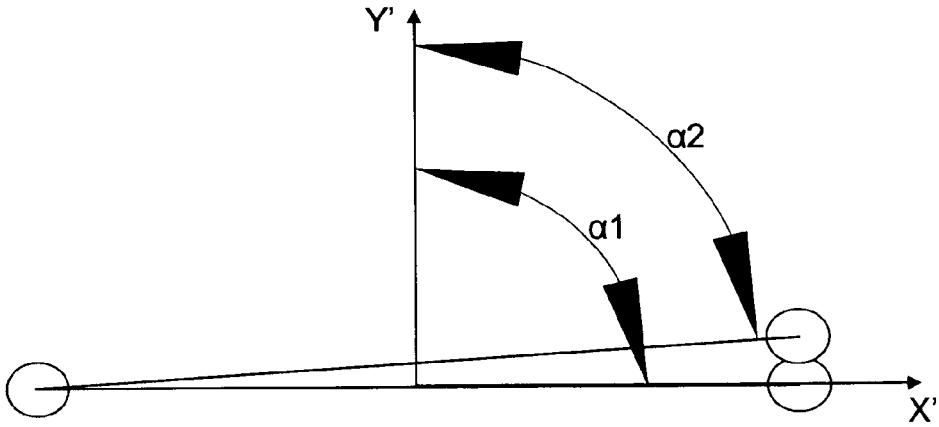
FIG. 11 illustrates the angles for stitches in a stitch type relative to the coordinate system for the pattern for the stitch type.

Each stitch in a pattern for a stitch type is positioned at a certain angle $\alpha$ (which is indexed for a plurality of stitches in the stitch type, e.g. $\alpha_1$ and $\alpha_2$) relative to the coordinates (X'-Y') for the pattern in the stitch type, see further FIGS. 10 and 11. The operator alters the direction of the stitches in a stitch type by changing the angle $\beta_i$, i.e. the Y' axis for the pattern of the stitch type is caused to assume the angle $\beta_i$ relative to the machine's (X-Y) coordinates. See FIGS. 7 and 12.

Figure 12:
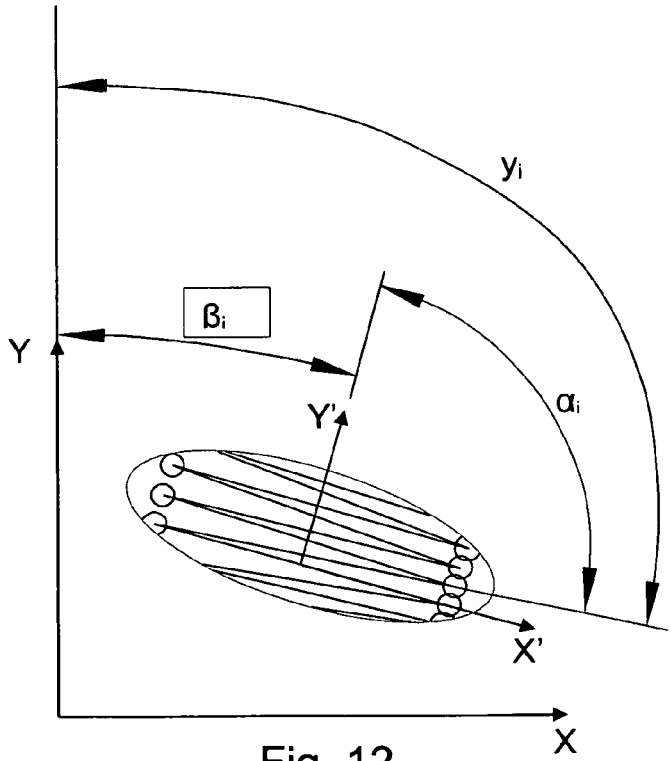
FIG. 12 illustrates the angles according to FIGS. 7 and 11 for the pattern for the second stitch type together with the sum of those angles and also the relationship between the coordinate system for the fabric and the coordinate system for the pattern for said stitch type.

The angle $\beta_i$ is related to the Y'-axis of the pattern for the stitch type, see further, for example, FIG. 12. The angle $\alpha_i$ for a specific stitch also affects, however, the final angle $\gamma_i$ for the stitch type. $\gamma_i$ is calculated by adding together $\alpha_i$ and $\beta_i$.

Figure 13:
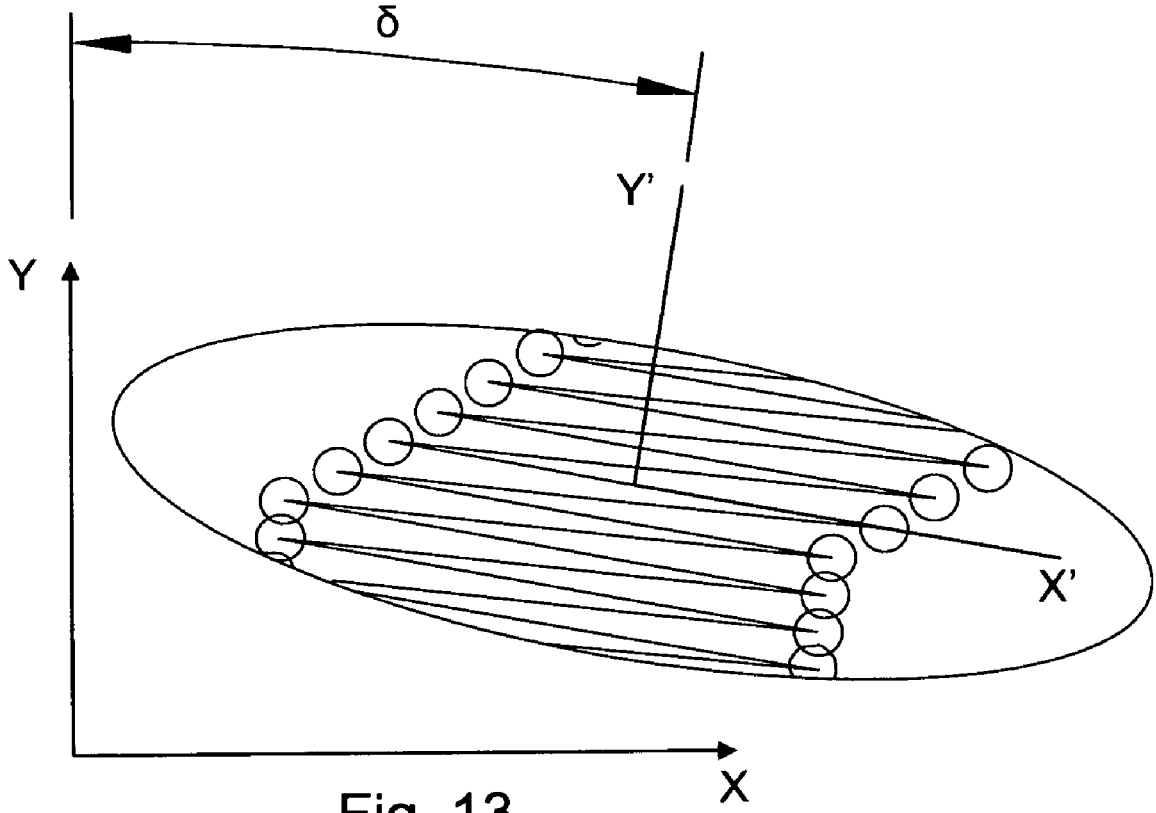
FIG. 13 illustrates the angles in a variant of the free-hand embroidering in which the angles between the patterns in consecutive stitches of the seam are unchanged.

A stitch angle control variant is illustrated in FIG. 13. In this case the angle between the stitches in a seam is fixed. The angle $\delta$ between the coordinate system X-Y of the hoop and the coordinate system X'-Y' for the pattern in the stitch type does not depend on the angle $\beta$. Instead, the angle $\delta$ is constant during the sewing of an FHE sequence. See further FIG. 13. The operator indicates the desired angle via a user interface (which may of course also be implemented as a regulating device on the control means 21) on the sewing machine before an FHE sequence is commenced. In this situation the angle according to the operator's input dictates the direction for the seam without any change of the direction for the pattern of the stitch type. The desired configuration is achieved instead by altering the length of the stitches. See further FIGS. 6 and 13.

In the free-hand embroidering it is possible, as previously mentioned, for the operator to set any of a number of different modes of operation described below.

In a first mode of operation the position of the control means 21 is recorded at a predetermined angle of one of the sewing machine's main axes during its rotation. One revolution of that axis corresponds to the formation of one stitch. The speed of the machine is calculated from the length of the vectors $V_i$ (see example in FIG. 7). However, the maximum speed for the respective stitch length is never exceeded. This means that the stitch length is never affected by the length of the vectors $V_i$.

In a second mode of operation, the position of the control means 21 is recorded repeatedly at predetermined intervals of time. The maximum speed for the respective stitch length is never exceeded. This means that the stitch length is never affected by the length of the vectors $V_i$. However, the recorded positions $V_i$ bear no relationship to the physical movement of the sewing machine's axes. This means that new positions $P_i$ may be recorded before the respective stitch has been sewn on the machine.

In a third mode of operation, the position of the control means 21 is recorded at a predetermined angle of one of the machine's main axes. One revolution of such an axis corresponds to the formation of one stitch. The maximum speed for the respective stitch length may be exceeded. If this happens, the stitch length may be decreased so that the required speed can be reached. This can be done up to the machine's absolute maximum sewing speed. This also corresponds to manually controlled free-hand embroidering with fabric movement by hand.

A variant of the proposed invention constitutes an embodiment in which the operator can continuously set the pattern width for the stitch type during free-hand embroidering, i.e. the extent in the X' direction of the stitch type (flat seam) according to FIG. 11. This may be accomplished with advantage with a regulating device disposed on the control means 21, e.g. by means of a setting handwheel of the kind provided in a computer mouse and depicted in FIG. 1. However, the stitch length may alternatively be set by means of an operating device on the sewing machine.

Definition

The expression "continuous detection" is to be taken as meaning that a signal is detected continuously, e.g. by being sampled at suitable intervals of time.

The expression "simultaneous sewing" means that the processor performs calculations and controls sewing substantially simultaneously with the guidance of the fabric via the control means.

A stitch is executed by the sewing of overthread and underthread between two consecutive knots.

Stitch type here means the pattern for a specific pattern repeatable by the sewing machine and comprising at least one stitch, e.g. straight seam or flat seam.

Seam means a sequence of stitches or stitch types.

The invention claimed is:

1. A method for free-hand embroidering on a sewing material with a sewing machine which has access to a memory for stitch data for a sewing pattern and a processor for reading said stitch data and for causing the sewing machine to execute stitches according to stitch data, which sewing machine has a needle which performs a reciprocating movement along substantially a perpendicular to the sewing material, and a sewing material feeder for moving the sewing material in a direction which comprises at least one of a component for a first coordinate and a component for a second coordinate, which processor, when an automatic mode is selected, guides movements according to said direction with respect to the position of the needle and synchronously with the movement of the needle for the execution of stitches according to the sewing pattern, and which method, when the sewing machine is switched to a free-hand mode, the method comprising:

storing stitch data in said memory for at least one stitch type for use during said free-hand embroidering, choosing a stitch type, generating first control signals, indicating a requested main sewing path by using a hand-operated control, detecting continuously said first control signals in a processor, using, in the processor, said first control signals and stored stitch data for the chosen stitch type, to generate second control signals, and controlling the sewing material feeder by the processor, via said second control signals, for the execution of stitches in accordance with stored stitch data for the chosen stitch type and the requested main sewing path indicated by the first control signals.

2. The method according to claim 1, further comprising:

calculating in the processor, from said first control signals, the speed of the movement, determining stitch length according to the speed of said movement, and controlling the sewing material feeder, via said second control signals, for the execution of stitches with said stitch length.

3. The method according to claim 2, further comprising:

controlling the sewing material feeder, via said second control signals, for sewing at a speed equal to said calculated speed when said calculated speed is not greater than the respective maximum machine-specific sewing speed of the sewing machine, where said respective maximum machine-specific sewing speed depends on the stitch type chosen.

4. The method according to claim 2, further comprising:

controlling the sewing material feeder, via said second control signals, for sewing at a speed determined by a mode of operation set by the operator of the sewing machine, in which a first mode of operation comprising that when the operator moves the control faster than what corresponds to the maximum sewing speed of the sewing machine, the direction and speed for a subsequent stitch are only detected when a preceding stitch has been sewn.

5. The method according to claim 2, further comprising:

controlling the sewing material feeder, via said second control signals, for sewing at a speed determined by a mode of operation set by the operator of the sewing machine, in which a second mode of operation comprising that when the operator moves the control faster than what corresponds to the maximum sewing speed of the sewing machine, stitches which the sewing machine cannot manage to sew simultaneously because its maximum sewing speed is exceeded are stored in a memory for non-simultaneous sewing of the stored stitches.

6. The method according to claim 2, further comprising:

controlling the sewing material feeder, via said second control signals, for sewing at a speed determined by a mode of operation set by the operator of the sewing machine, in which a third mode of operation comprising that when the operator moves the control faster than what corresponds to the maximum sewing speed of the sewing machine, the processor reduces the stitch length in order to reach a higher sewing speed.

7. The method according to claim 1, further comprising:

controlling the stitch width via a setting device disposed on said control or on the sewing machine.

8. A system for free-hand embroidering on a sewing material comprising a sewing machine which has access to a memory for stitch data for a sewing pattern and a processor for reading said stitch data and for causing the sewing machine to execute stitches according to stitch data, which sewing machine has a needle which performs a reciprocating movement along substantially a perpendicular to the sewing material, and an sewing material feeder for moving the sewing material in a direction which comprises at least one of a component for a first coordinate and a component for a second coordinate, the system comprising:

a control which is operable by an operator and signal-integrated with the processor, with the possibility of a free-hand mode being chosen in the system in order to generate first control signals from the control to the processor, where the first control signals indicate a requested main sewing path by using a hand-operated control, continuously detect said first control signals with the processor, using, in the processor, said first control signals and stored stitch data for the chosen stitch type, to generate second control signals, after which the processor, via said second control signals, controls the sewing material feeder for the execution of stitches in accordance with stored stitch data for the chosen stitch type and the requested main sewing path indicated by the first control signals.

9. The system according to claim 8, wherein the control comprises any one of the following: a computer mouse, a keyboard, a light pen, a joystick, a drawing screen, a touch screen, a touch pad, a roller ball, a drawing tablet.

10. The system according to claim 9, wherein said control comprises a transmitter for transmitting said first signals to the processor by wire or wirelessly.

11. The system according to claim 8, wherein the processor guides the sewing material feeder via said second control signals which causes a driver to move the sewing material feeder in at least one out of the direction of the X coordinate and the direction of the Y coordinate.

12. A computer program product, comprising:

a computer readable medium; and computer program instructions recorded on the computer readable medium and executable by a processor for executing a method comprising storing stitch data in a memory for at least one stitch type for use during free-hand embroidering, choosing a stitch type, generating first control signals, indicating a requested main sewing path by using a hand-operated control, detecting continuously said first control signals in a processor, using, in the processor, said first control signals and stored stitch data for the chosen stitch type, to generate second control signals, and controlling the sewing material feeder by the processor, via said second control signals, for the execution of stitches in accordance with stored stitch data for the chosen stitch type and the requested main sewing path indicated by the first control signals.

13. The method according to claim 1, wherein the hand-operated control comprises a joystick or computer mouse.

14. The method according to claim 7, wherein the setting device comprises a handwheel.

* * * * *